United States Patent [19]

Meredith et al.

[11] 4,411,667

[45] Oct. 25, 1983

[54] TRANSFER PRINTING METAL SHEET COATED WITH THERMOSET LAYER WHILE STILL HOT FROM CURING

[75] Inventors: Douglas Meredith; James A. Cronin, both of Abergavenny, Wales

[73] Assignee: British Steel Corporation, London, England

[21] Appl. No.: 354,074

[22] Filed: Mar. 2, 1982

[30] Foreign Application Priority Data

Mar. 10, 1981 [GB] United Kingdom ..... 8107541

[51] Int. Cl.[3] ..... B41M 5/00; B44C 1/16

[52] U.S. Cl. ..... 8/471; 8/522

[58] Field of Search ..... 8/471, 522

[56] References Cited

U.S. PATENT DOCUMENTS

| | | | |
|---|---|---|---|
| 3,792,968 | 2/1974 | Rickenbacher et al. | 8/471 |
| 3,829,286 | 8/1974 | Anzai et al. | 8/471 |
| 3,952,131 | 4/1976 | Sideman | 8/468 |
| 4,171,230 | 10/1979 | Bolliser et al. | 8/471 |
| 4,177,299 | 12/1979 | Severns et al. | 8/471 |
| 4,201,821 | 5/1980 | Fromson et al. | 428/203 |
| 4,202,663 | 5/1980 | Haish | 8/471 |
| 4,352,721 | 10/1982 | Park et al. | 8/471 |
| 4,354,851 | 10/1982 | Hix et al. | 8/471 |

FOREIGN PATENT DOCUMENTS

| | | |
|---|---|---|
| 1111717 | 11/1981 | Canada . |
| 14901 | 9/1980 | European Pat. Off . |
| 2817566 | 10/1978 | Fed. Rep. of Germany . |
| 52-132084 | 11/1977 | Japan . |
| 349683 | 6/1931 | United Kingdom . |
| 1052625 | 12/1966 | United Kingdom . |
| 1189026 | 4/1970 | United Kingdom . |
| 1190889 | 2/1971 | United Kingdom . |
| 1221126 | 2/1971 | United Kingdom . |
| 1444368 | 7/1976 | United Kingdom . |
| 1463596 | 2/1977 | United Kingdom . |
| 1517832 | 7/1978 | United Kingdom . |

*Primary Examiner*—A. Lionel Clingman

*Attorney, Agent, or Firm*—Bacon & Thomas

[57] ABSTRACT

This invention relates to a method of transfer printing in which a continuous length of strip is coated with a thermosetting material e.g. and alkyd, polyester, polyurethane or epoxy paint, and brought into contact immediately after curing with a continuous strip of printed material. The temperature of the strip at this time lies between 180° C. and 280° C. and the contact is effected during the passage of both strips between resiliently surfaced rollers at a pressure of at least 50 p.s.i., the ink print being transferred to the strip by sublimation.

12 Claims, 1 Drawing Figure

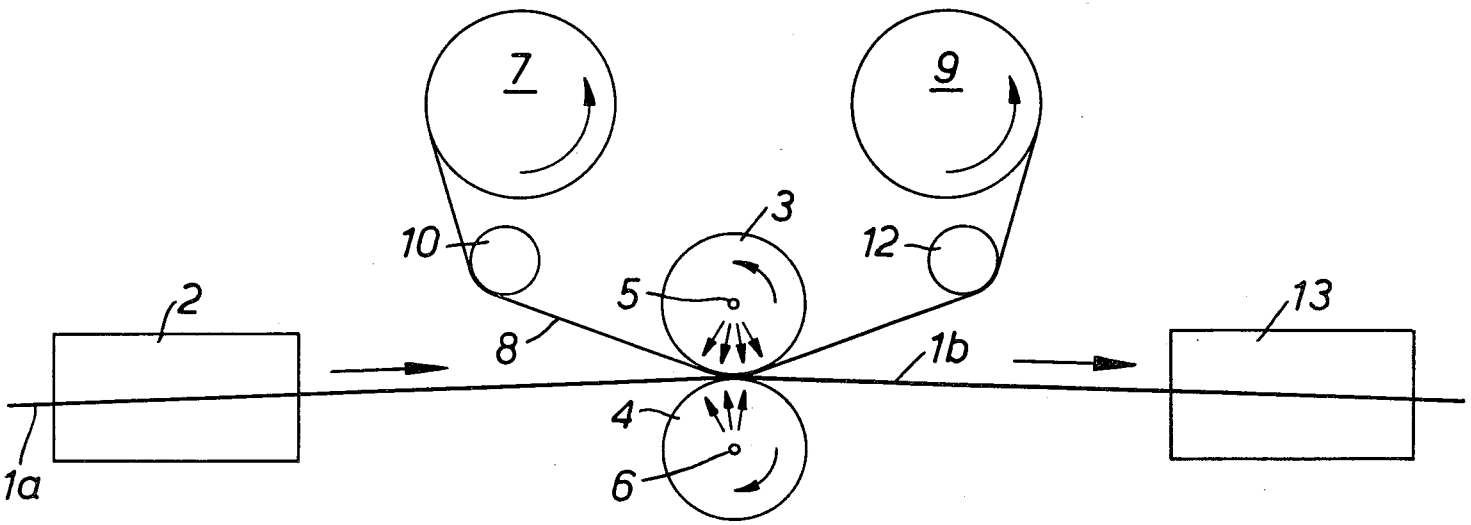
13
9
12
1b
3
5
4
6
7
10
8
2
1a

TRANSFER PRINTING METAL SHEET COATED WITH THERMOSET LAYER WHILE STILL HOT FROM CURING

This invention relates to transfer printing on to a painted substrate.

From one aspect the present invention provides a method of transfer printing in which a continuous length of strip is coated with a thermo-setting material and brought into contact immediately after curing whilst at a temperature of between 180° C. and 280° C. with a continuous strip of printed material, the contact being effected during the passage of both strips between resiliently surfaced rollers at a pressure of at least 50 p.s.i., the ink print being transferred to the strip by sublimation.

The ink may be printed on a paper substrate and the strip to which this ink is transfer printed may be a steel strip on to which e.g. an alkyd, polyester, polyurethane or epoxy paint has been applied. This paint may in turn be surfaced with a thermo-setting lacquer.

In accordance with this invention then transfer printing on to a metal substrate is effected in a continuous line which has not been achieved before and very high speeds may be achieved, e.g. 10–100 meters per minute, utilising the residual heat in the strip following the paint curing. Since this is the sole source of heat, the paper roll is "cold," a significant saving in energy is additionally achieved compared with single sheet batch processes adopted hitherto or "web" transfer, where a continuous paper web is held under pressure over a heated roll, around which is wrapped the material to which the printing is to be applied.

In order that the invention may be fully understood, one embodiment thereof will now be described, by way of example, with reference to the accompanying diagrammatic drawing which shows part of a continuous strip coating line on which transfer printing is effected in accordance with this invention.

Referring now to the drawing, a steel strip 1*a* which has been prepared, primed and coated on its upper surface with a thermo-setting paint by e.g. a roller coater, including (optionally) a surface coating of thermo-setting lacquer, issues from a curing oven 2 at a temperature of between 190° C. and 250° C., preferably around 230° C., at a speed of say 25 to 40 meters per minute. Twin idler rollers 3,4 are sited downstream of the oven. These rollers have a siliconised rubber coating on their outer surface and are water-cooled internally by spray units 5,6. More particularly, the surface of the upper roller (which is fixed) has a typical Shore hardness of 70 whilst the surface of the lower (hydraulically movable) roller has a Shore hardness of 90. A pay-off reel 7 from which printed paper 8 is dispensed and a take-up reel 9 for collecting this (exhausted) paper flank the roller 3, and the paper together with the coated strip pass between the nip of rollers 3,4, via a bowed anticreasing 'Mount Hope' roller 10 and a diverter roll 12. Each of the reels 7 and 9 is provided with a clutch mechanism and a brake in order to maintain the correct tension, and the whole roller assemblies may be steered to maintain alighment.

The paper is such that it is non-absorbent to the ink, and any convenient printing process may be employed to impart the pattern, e.g. photogravure flexography, screen printing, letterpress or photolithography.

The print on the paper is in contact with the painted surface of the steel strip under pressure, typically around 1000 p.s.i., at the area of roller contact and at the elevated temperature of the strip the dye in the ink sublimes, that is, it transposes directly from the solid to the gaseous phase without melting; the resulting chemical change in the contacting painted steel strip yields a very definitive and accurately reproduced copy of the original print in this painted surface. The period of contact—which is almost 'line' contact save for the yielding displacement of the resilient surfaces of the rollers 3,4—is very short, the patterned painted strip 1*b* then passing through a quenching station 13 before being waxed, if required, and coiled for dispatch.

The paint may or may not have a colouring pigment and as mentioned it may be surfaced with a clear lacquer.

The ink employed may contain dissolved or finely dispersed dyes, which of course sublime under the conditions stated, a solvent mixture—advantageously anhydrous—and a binder or thickener which is stable to heat.

The continuous coating line on which this process may be adopted may be quite conventional embodying the usual treatment stations, tension levellers, accumulators and stitching stations (for joining coils).

Thus the method may readily be adopted in existing plant consistent with siting the equipment immediately 'downstream' from the final curing oven so that the residual temperature of the strip may be utilised for the sublimation phenomenon.

Although the invention has been described with reference to the particular embodiment illustrated, it is to be understood that various modifications may readily be made without departing from the scope of this invention. For example, steel is only one substrate medium, other metals, or nonmetals provided they retain sufficient heat following curing, may readily be coated. Further the inked pattern may be deposited on a medium other than paper, the only essential prerequisite being that the dye/dyes be transferable by sublimation. Again, the pressures adopted may vary dependent on the various material characteristics and other operating parameters; 1000 p.s.i. has been disclosed as being typical but other pressures in excess of 50 p.s.i. and up to say 1300/1400 p.s.i. may readily be utilized.

We claim:

1. A method of transfer printing in which a continuous length of metal strip is coated with a thermo-setting coating material and cured, in which, immediately after curing at a temperature of between 180° C. and 280° C., the coated surface of the strip is brought into contact with a continuous strip of printed material comprising an ink print containing a sublimable dye, the contact being effected during the passage of both strips between the nip of two opposed resiliently surfaced rollers at a pressure of at least 50 p.s.i., the dye of the ink print being transferred by sublimation utilizing the residual heat of the strip following the curing of the thermosetting coating material.

2. A method according to claim 1, in which the ink is printed on a paper substrate.

3. A method according to claim 2, in which the strip on which the dye of the ink is transfer printed is a metal on to which a thermo-setting paint has been applied and cured.

4. A method according to claim 3, in which the paint is surfaced with a clear thermo-setting lacquer.

5. A method according to claim 1, in which the two rollers are water-cooled.

6. A method according to claim 5, in which one of the rollers rotates on a fixed axis whereas the other roller axis is movable to adjust the pressure exerted on the strips.

7. A method according to claim 6, in which the temperature at which the strip issues from the curing station is between 190° C. and 250° C. and the pressure exerted by the rollers is of the order of 1000 p.s.i.

8. A method according to claim 7, in which the strip on which the dye of the ink is transfer printed is passed through a quenching station.

9. A method according to claim 8, in which the strip of printed material is dispensed from a pay-off reel and collected on a take-up reel each of which is provided with a brake and clutch mechanism, an intermediate guiding roller being disposed between each said reel and the nip between the resilient rollers.

10. A method of transfer printing in which a continuous length of steel strip is coated with a thermo-setting coating material and cured, in which immediately after curing at a temperature between 190° C. and 250° C. the coated surface of the strip is brought into contact with a continuous strip of printed paper comprising an ink print containing a sublimable dye, the contact being effected during the passage of both strips between the nip of two opposed resiliently surfaced water-cooled rollers at a pressure of the order of 1000 p.s.i., the ink print being transferred by sublimation of the dye utilizing the residual heat of the strip following the curing of the thermo-setting coating material.

11. A method according to claim 1, in which the coated strip on which the dye of the ink is to be transfer printed passes between the rollers at a speed of about 10 to 100 meters per minute.

12. A method according to claim 3, in which the thermo-setting paint is selected from the group consisting of alkyd, polyester, polyurethane and epoxy paints.

* * * * *